US008662494B2

(12) United States Patent
Shirane et al.

(10) Patent No.: US 8,662,494 B2
(45) Date of Patent: Mar. 4, 2014

(54) RECORDING MEDIUM FEEDING DEVICE AND RECORDING APPARATUS

(71) Applicant: Seiko Epson Corporation, Tokyo (JP)

(72) Inventors: Tatsuya Shirane, Shiojiri (JP); Tetsuya Tamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/775,682

(22) Filed: Feb. 25, 2013

(65) Prior Publication Data

US 2013/0221608 A1 Aug. 29, 2013

(30) Foreign Application Priority Data

Feb. 27, 2012 (JP) ..... 2012-039680

(51) Int. Cl.
*B65H 3/44* (2006.01)
*B65H 5/26* (2006.01)

(52) U.S. Cl.
USPC ..... 271/9.11; 271/167

(58) Field of Classification Search
USPC ..... 271/9.11, 167
See application file for complete search history.

(56) References Cited

U.S. PATENT DOCUMENTS

| | | | | |
|---|---|---|---|---|
| 7,677,548 | B2 * | 3/2010 | Chino | 271/9.11 |
| 2007/0075477 | A1 | 4/2007 | Shiohara | |
| 2011/0180986 | A1 | 7/2011 | Okawa et al. | |
| 2012/0161381 | A1 * | 6/2012 | Nakamura et al. | 271/9.11 |
| 2012/0175838 | A1 * | 7/2012 | Nakamura et al. | 271/9.11 |
| 2013/0001856 | A1 * | 1/2013 | Uchida | 271/9.11 |

FOREIGN PATENT DOCUMENTS

| | | |
|---|---|---|
| JP | 2007-091445 | 4/2007 |
| JP | 2011-148622 | 8/2011 |

* cited by examiner

*Primary Examiner* — David H Bollinger
(74) *Attorney, Agent, or Firm* — Workman Nydegger

(57) ABSTRACT

A recording medium feeding device includes a lower stage side tray which stores a recording medium, an upper stage side tray which is provided above the lower stage side tray and stores the recording medium, a first separation inclined surface which is opposite to a tip of the recording medium which is stored in the lower stage side tray and the upper stage side tray and extends along a feed path of the recording medium, and a second separation inclined surface in which a trailing end in the feed path is positioned below a bottom surface of the upper stage side tray, and thus, which is opposite to the tip of the recording medium which is stored in the lower stage side tray and is not opposite to the tip of the recording medium which is stored in the upper stage side tray.

9 Claims, 10 Drawing Sheets

RECORDING MEDIUM FEEDING DEVICE AND RECORDING APPARATUS

BACKGROUND

1. Technical Field

The present invention relates to a recording medium feeding device and a recording apparatus which includes the recording medium feeding device.

In the present application, the recording apparatus includes types such as an ink jet printer, a line printer, a copier, and a facsimile machine.

2. Related Art

In JP-A-2011-148622 and JP-A-2007-91445, in a recording apparatus such as an ink jet printer, a recording medium feeding device is provided which separates one sheet of recording medium from a paper feed tray which laminates and supports a plurality of recording media and feeds the separate recording medium to a recording portion or the like which performs recording processing. In the recording medium feeding device, a separation inclined portion is provided which is inclined at a predetermined angle with respect to a placement surface of the recording media of the paper feed tray. The recording media which are laminated on the paper feed tray abut a pickup roller and are discharged toward the separation inclined portion. At this time, the tips of the recording media, which are overlapped in a plurality of sheets and are discharged, contact the inclined surface of the separation inclined portion and receive effects of load (which includes a reaction force and a friction force) in a direction opposite to the discharging direction. Thereby, the overlapped recording media are separated by the separation inclined portion, and only the recording medium which is positioned uppermost is discharged to the downstream side of a feed path.

However, recently, there are a variety of types (material, thickness, size, or the like) of recording media which can perform recording processing. In the various types of recording media, the loads (reaction force, friction force) which are required for the separation of the recording medium in the inclined surface of the separation inclined portion are different according to the material or the thickness of the recording medium. Thereby, in JP-A-2011-148622, the recording medium feeding device is disclosed in which the reaction force which is one of the separation conditions of the recording medium is adjusted along with stiffness of the recording medium.

In the recording medium feeding device, a space which makes a portion of the recording medium escape along a discharging direction is formed on a portion of the inclined surface which is positioned in a region opposite to the pickup roller in the discharging direction of the recording medium. In the recording medium feeding device, when the pickup roller contacts the recording medium, a portion of the recording medium escapes to the space and is formed, and thus, the reaction force in which the recording medium receives from the separation inclined portion can be decreased. Since the deformation amount of the recording medium into the space is changed according to the stiffness of the recording medium in the recording medium feeding device, the reaction force in which the recording medium is received from the separation inclined surface can be adjusted along with the stiffness of the recording medium.

However, as disclosed in JP-A-2007-91445, in one detachable paper cassette (tray), a cassette having a two-stage type structure which includes a paper storage portion in an upper stage and a lower stage also exists. In the two-stage type paper cassette, in most cases, the upper stage paper storage portion is formed so as to be smaller than the lower stage paper storage portion. In addition, in most cases, exclusive paper such as postcard paper or photographic paper is stored in the upper stage paper storage portion, and regular paper is stored in the lower stage paper storage portion. Since the separation inclined portion is used in both the upper stage paper storage portion and the lower stage paper storage portion, if the separation conditions are set according to the paper which is stored in the upper stage paper storage portion, the separation conditions are not matched with respect to the kind of the paper which is stored in the lower stage paper storage portion, that is, it is not necessarily possible to set appropriate conditions for both.

SUMMARY

An advantage of some aspects of the invention is to provide a recording medium feeding device and a recording apparatus capable of setting appropriate separation conditions with respect to each paper storage portion in a configuration in which a separation inclined surface is used for a plurality of paper storage portions in common.

Moreover, in the recording apparatus, there are various terms such as a "cassette" or a "tray" as the name of the paper storage portion which stores the paper. However, in the present specification, the term "tray" is used.

According to a first aspect of the invention, there is provided a recording medium feeding device, including: a lower stage side tray which stores a recording medium; an upper stage side tray which is provided above the lower stage side tray and stores the recording medium; a first separation inclined surface which is an inclined surface which rises from a position of a bottom surface of at least the lower stage side tray, extends up to above a position of a bottom surface of the upper stage side tray, and thus, is opposite to a tip of the recording medium which is stored in the lower stage side tray and the upper stage side tray, and applies a separation operation with respect to the tip of the recording medium; and a second separation inclined surface which is an inclined surface which rises from the position of the bottom surface of at least the lower stage side tray, in which a trailing end of the second separation inclined surface is positioned below the bottom surface of the upper stage side tray, and thus, which is opposite to the tip of the recording medium which is stored in the lower stage side tray without being opposite to the tip of the recording medium which is stored in the upper stage side tray and applies a separation operation with respect to the tip of the recording medium.

According to the first aspect, when the recording medium is fed, since the recording medium which is stored in the lower stage side tray contacts the first separation inclined surface and the second separation inclined surface and the recording medium which is stored in the upper stage side tray contacts only the first separation inclined surface, appropriate separation conditions can be set according to each of the recording media which are stored in the lower stage side tray and the upper stage side tray.

In the recording medium feeding device, a regulating portion which regulates deformation of the upper stage side tray may be provided above the second separation inclined surface.

According to the recording medium feeding device, in addition to effects similar to the first aspect, since the regulating portion supports the upper stage side tray, it is possible to prevent the upper stage side tray from being deformed due to the weight of the upper stage side tray or weight of the recording medium in addition to its own weight.

In the recording medium feeding device, the first separation inclined surface and the second separation inclined surface may be formed so that a friction force between the tip of the recording medium and the second separation inclined surface is larger than a friction force between the tip of the recording medium and the first separation inclined surface.

According to the recording medium feeding device, in addition to effects similar to the above-described effects, since the friction force which is larger than the friction force applied to the recording medium which is stored in the upper stage side tray can be applied to the recording medium which is stored in the lower stage side tray, separability of the recording medium which is stored in the lower stage side tray can be improved.

In the recording medium feeding device, an inclination angle of the second separation inclined surface may be larger than an inclination angle of the first separation inclined surface.

According to the recording medium feeding device, in addition to effects similar to the above-described effects, since the tip of the recording medium which is stored in the lower stage side tray contacts the second separation inclined surface having the inclination angle which is larger than the inclination angle of the first separation inclined surface, load which is larger than that of the recording medium which is stored in the upper stage side tray can be applied to the recording medium which is stored in the lower stage side tray. Thereby, separability of the recording medium which is stored in the lower stage side tray can be improved.

In the recording medium feeding device, the first separation inclined surface may be formed on a first movable member which can displace in directions which advance to and retreat from the tip of the recording medium and is biased toward the tip of the recording medium, and on a first fixing member which does not displace in the advancing and retreating directions. In addition, when the recording medium is not discharged, the first separation inclined surface portion which is formed on the first movable member may be a protrusion state in which the first separation inclined surface portion further protrudes to the tip side of the recording medium than the first separation inclined surface portion which is formed on the first fixing member. When a first recording medium having a predetermined stiffness is discharged, the first separation inclined surface portion which is formed on the first movable member may maintain the protrusion state. Moreover, when a second recording medium having higher stiffness than the stiffness of the first recording medium is discharged, the first movable member may be pushed and displaced by the tip of the second recording medium, and thus, the tip of the second recording medium may contact the first separation inclined surface portion which is formed on the first fixing member.

According to the recording medium feeding device, in addition to effects similar to the above-described effects, the separation inclined surface which contacts the tip of the recording medium is switched to the first separation inclined surface portion which is formed on the first movable member or the first separation inclined surface portion which is formed on the first fixing member according to the strength and weakness of the stiffness of the recording medium, and thus, the friction force which is generated in the tip of the recording medium can be adjusted.

In the recording medium feeding device, the second separation inclined surface may be formed on a second movable member which can displace in directions which advance to and retreat from the tip of the recording medium and is biased toward the tip of the recording medium. In addition, when the recording medium is not discharged, the first separation inclined surface portion which is formed on the first movable member and the second separation inclined surface portion which is formed on the second movable member may be a protrusion state in which the first separation inclined surface portion and the second separation inclined surface portion further protrude to the tip side of the recording medium than the first separation inclined surface portion which is formed on the first fixing member. When the first recording medium is discharged, the first separation inclined surface portion which is formed on the first movable member and the second separation inclined surface portion which is formed on the second movable member may maintain the protrusion state. Moreover, when the second recording medium is discharged, the first movable member and the second movable member may be pushed and displaced by the tip of the second recording medium, and thus, the tip of the second recording medium may contact the first separation inclined surface portion which is formed on the first fixing member.

According to the recording medium feeding device, in addition to effects similar to the above-described effects, the separation inclined surface which contacts the tip of the recording medium is switched to the first separation inclined surface portion which is formed on the first movable member and the second separation inclined surface portion which is formed on the second movable member, or the first separation inclined surface portion which is formed on the first fixing member according to the strength and weakness of the stiffness of the recording medium, and thus, the friction force which is generated in the tip of the recording medium can be adjusted.

In the recording medium feeding device, the second separation inclined surface may be also formed on a second movable member which is not displaced in directions which advance to and retreat from the tip of the recording medium, in addition to the second movable member. In addition, when the recording medium is not discharged, the first separation inclined surface portion which is formed on the first movable member and the second separation inclined surface portion which is formed on the second movable member may be a protrusion state in which the first separation inclined surface portion and the second separation inclined surface portion further protrude to the tip side of the recording medium than the first separation inclined surface portion which is formed on the first fixing member and the second separation inclined surface portion which is formed on the second fixing member. When the first recording medium is discharged, the first separation inclined surface portion which is formed on the first movable member and the second separation inclined surface portion which is formed on the second movable member may maintain the protrusion state. Moreover, when the second recording medium is discharged, the first movable member and the second movable member may be pushed and displaced by the tip of the second recording medium, and thus, the tip of the second recording medium may contact the first separation inclined surface portion which is formed on the first fixing member and the second separation inclined surface portion which is formed on the second fixing member.

According to the recording medium feeding device, in addition to effects similar to the above-described effects, the separation inclined surface which contacts the tip of the recording medium is switched to the first separation inclined surface portion which is formed on the first movable member and the second separation inclined surface portion which is formed on the second movable member, or the first separation inclined surface portion which is formed on the first fixing member and the second separation inclined surface portion which is formed on the second fixing member according to the strength and weakness of the stiffness of the recording medium, and thus, the friction force which is generated in the tip of the recording medium can be adjusted.

In the recording medium feeding device, the first separation inclined surface which is formed on the first movable member may be formed in a step shape along the feed path.

According to the recording medium feeding device, in addition to effects similar to the above-described effects, since the first separation inclined surface is formed in a step shape, the friction force between the first separation inclined surface and the tip of the recording medium is increased, and thus, separability of the recording medium can be improved.

According to a second aspect of the invention, there is provided a recording apparatus including: a recording unit which performs recording on a recording medium; and the above-described recording medium feeding unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
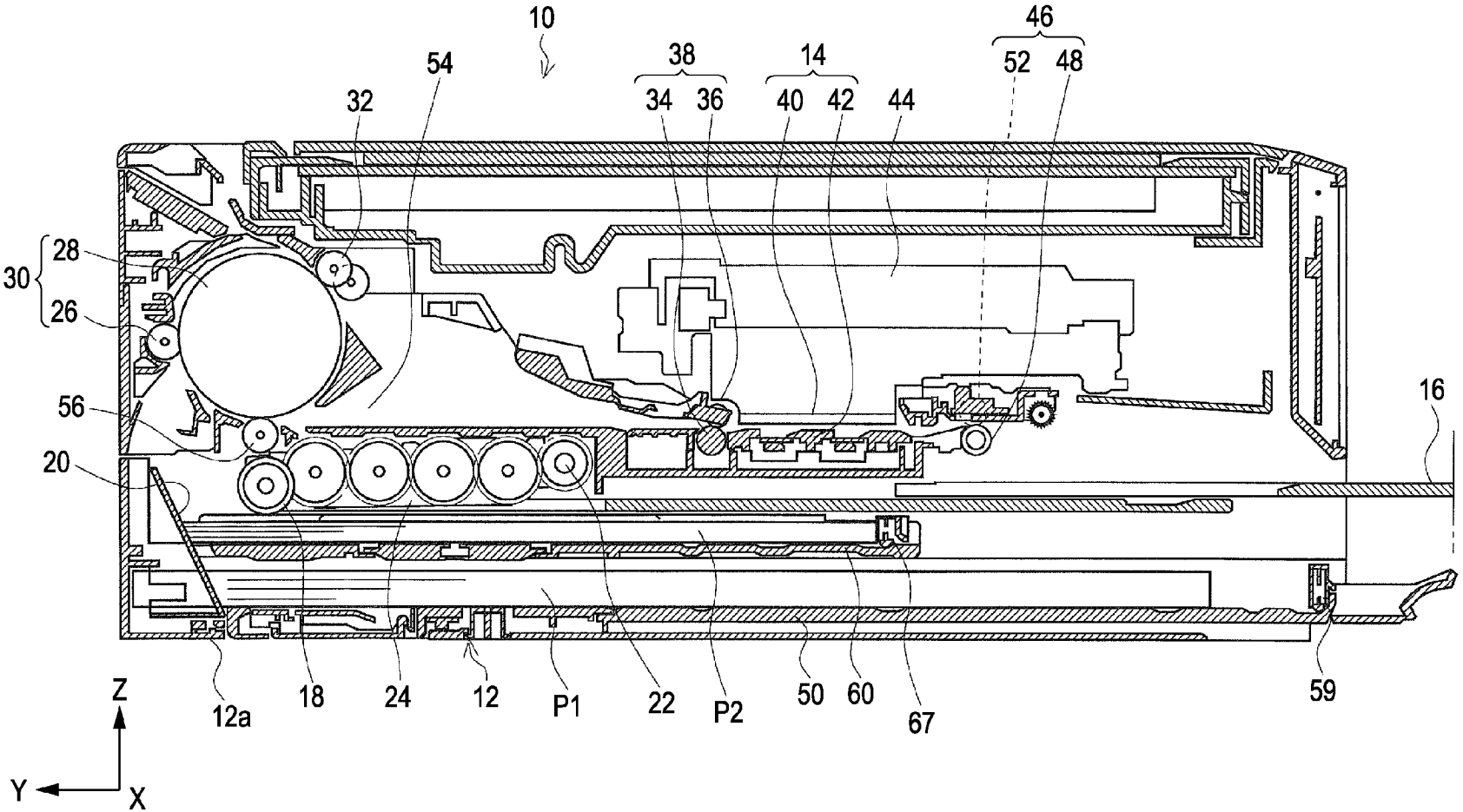
FIG. 1 is a side cross-sectional view showing a paper transport path of a printer according to the invention.

Hereinafter, embodiments of the invention will be described with reference to drawings. Moreover, the same configurations in each embodiment are attached by the same reference numerals and are described in only the initial embodiment, and the descriptions of the configurations are omitted in the subsequent embodiments.

Figure 2:
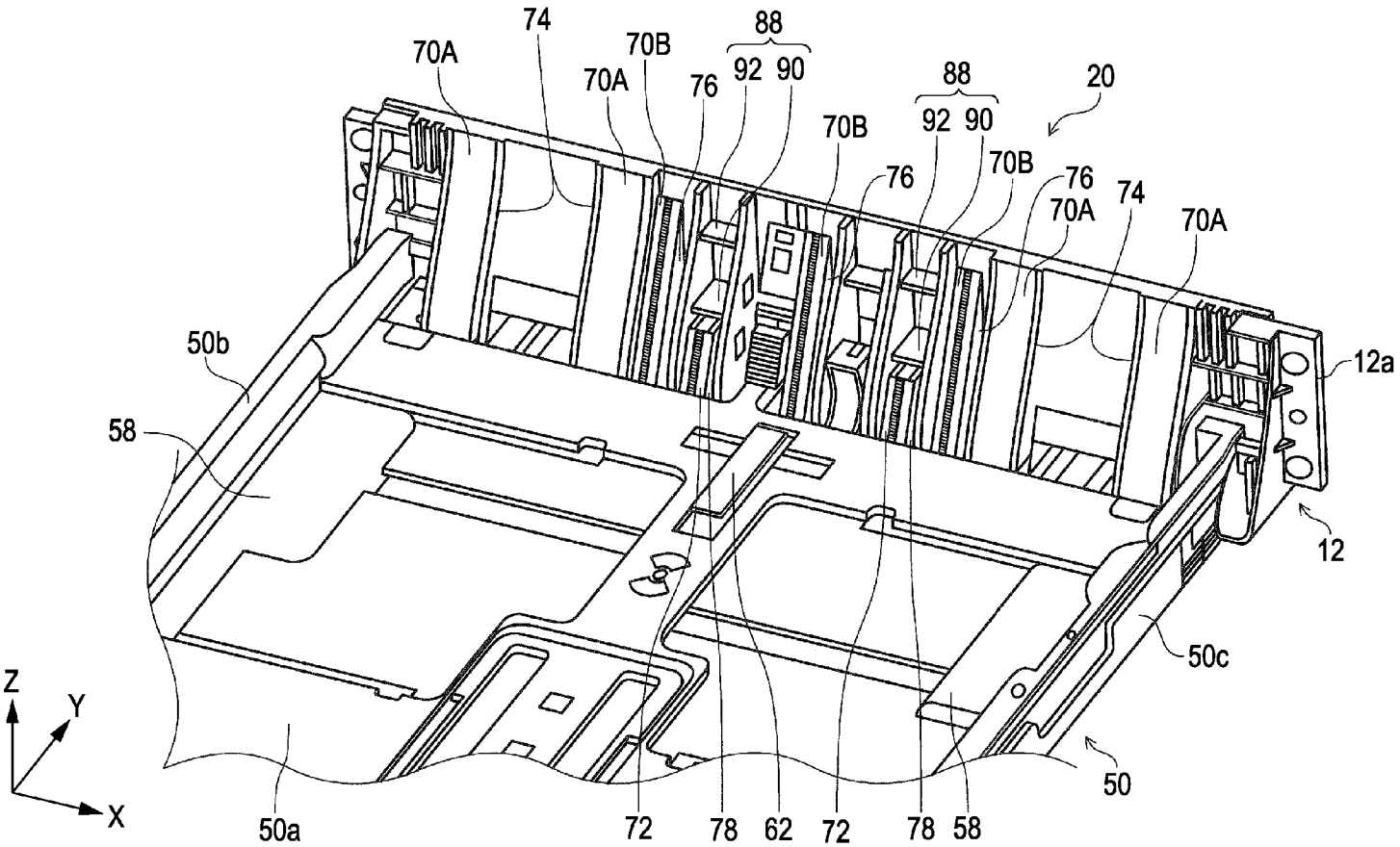
FIG. 2 is a perspective view showing the tip side of paper in a lower stage side tray of a first embodiment.
Figure 3:
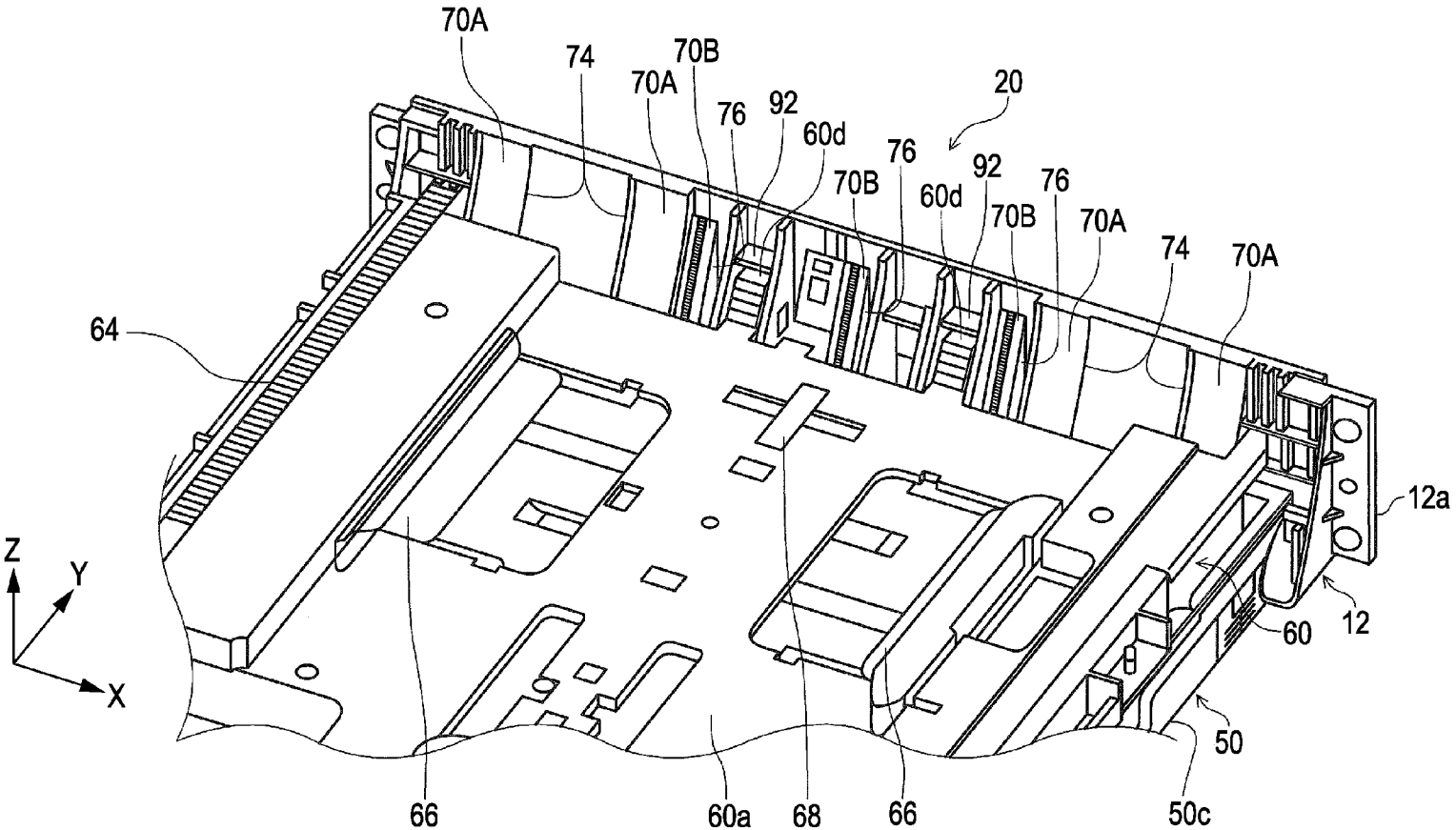
FIG. 3 is a perspective view showing the tip side of the paper in an upper stage side tray of the first embodiment.
Figure 4:
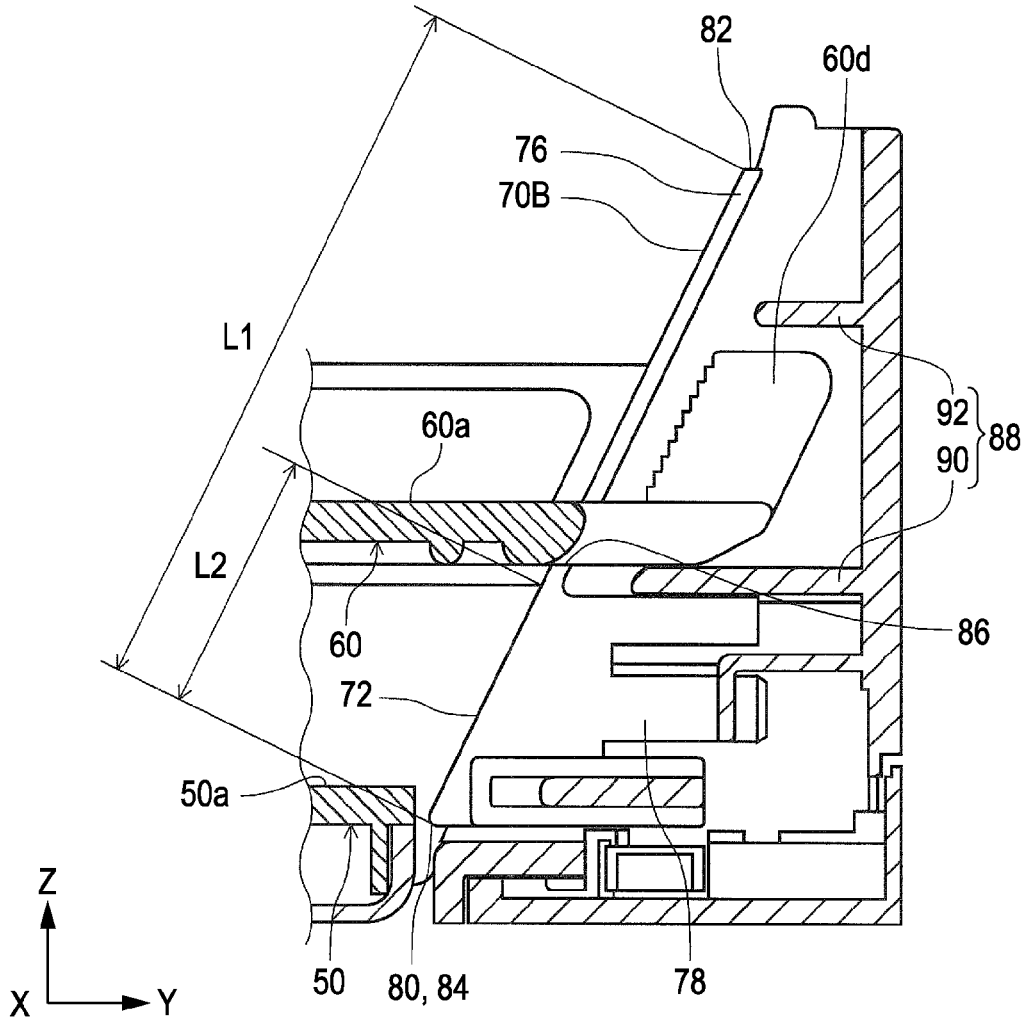
FIG. 4 is a side view showing a relationship between the upper stage side tray and a second movable member of the first embodiment.

FIG. 1 is a side cross-sectional view showing a paper transport path of an ink printer (hereinafter, referred to as a "printer") 10 which is an embodiment of a "recording apparatus", FIG. 2 is a perspective view showing the tip side of paper in a lower stage side tray of a first embodiment, FIG. 3 is a perspective view showing the tip side of the paper in an upper stage side tray of the first embodiment, and FIG. 4 is a side view showing a relationship between the upper stage side tray and a second movable member of the first embodiment.

Figure 5:
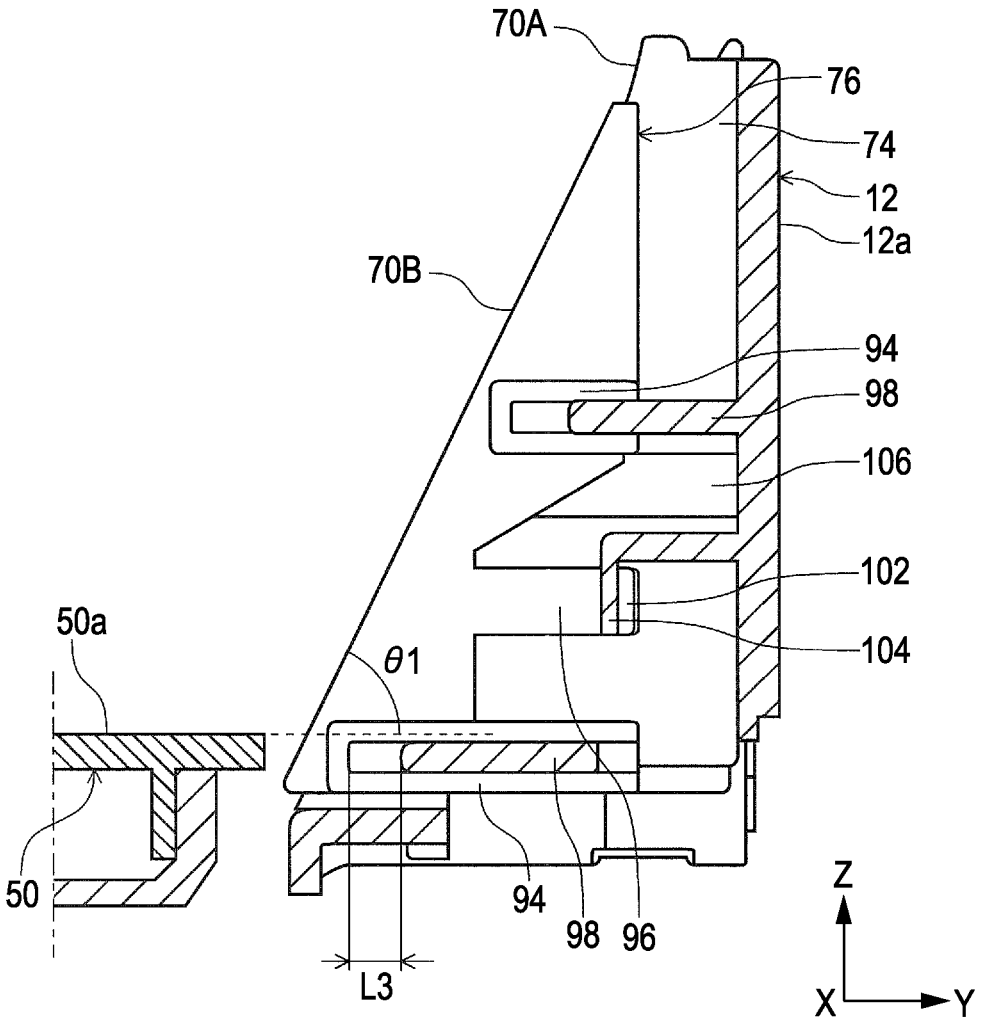
FIG. 5 is a side cross-sectional view of a first movable member of the first embodiment.
Figure 6:
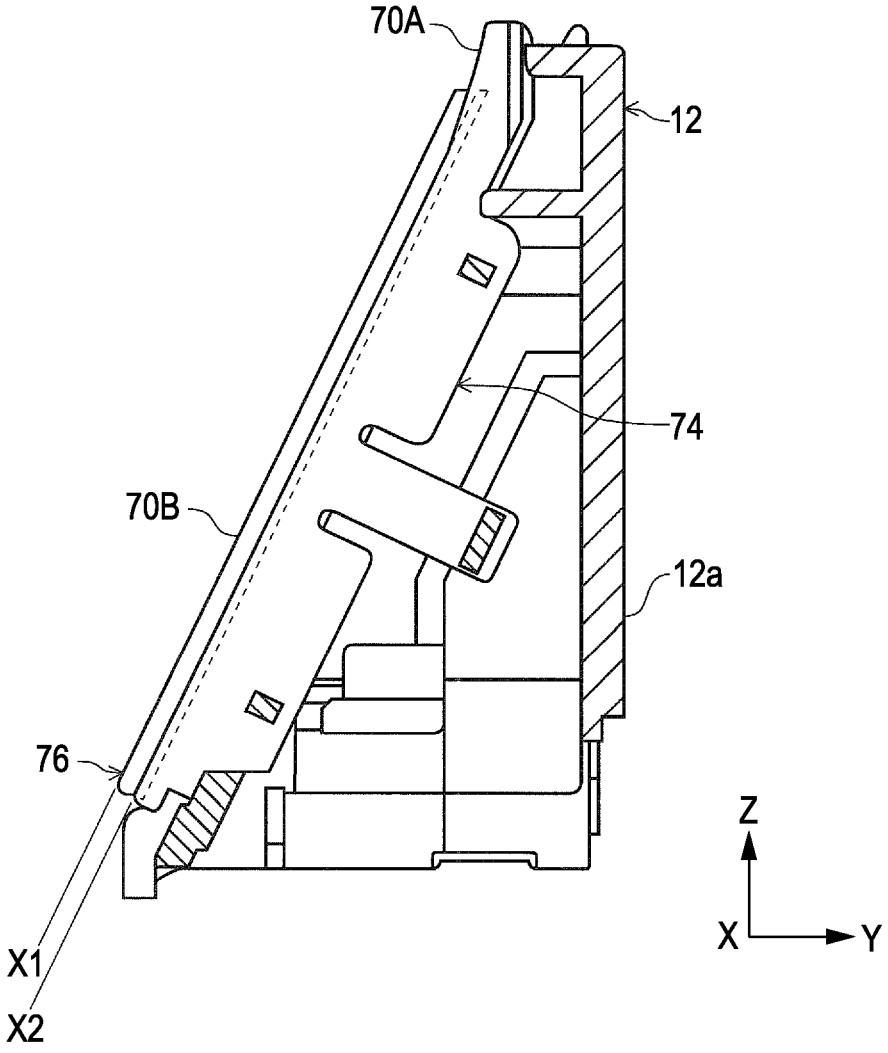
FIG. 6 is a side view showing a relationship between the first movable member and a first fixing member of the first embodiment.
Figure 7A:
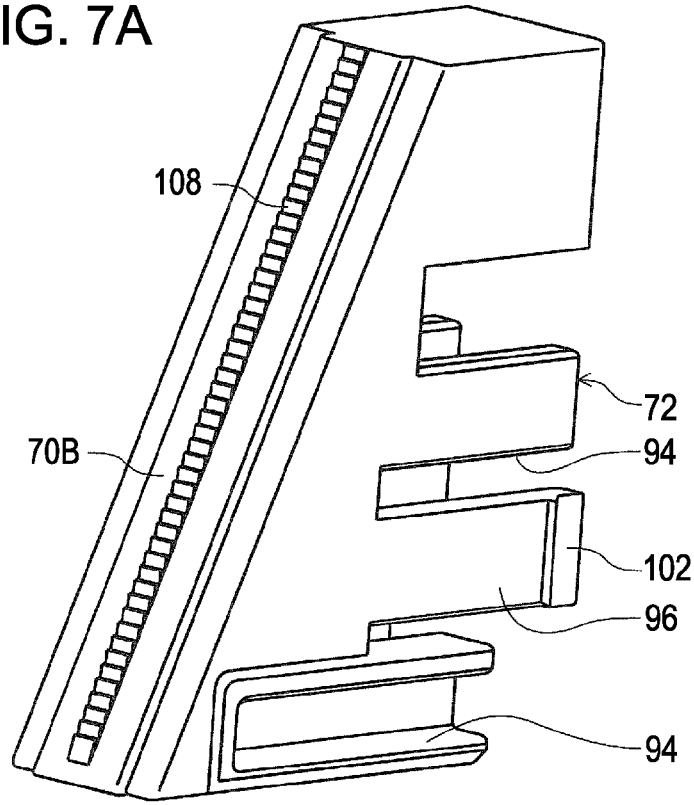
FIG. 7A is a perspective view of the first movable member according to the first embodiment.
Figure 7B:
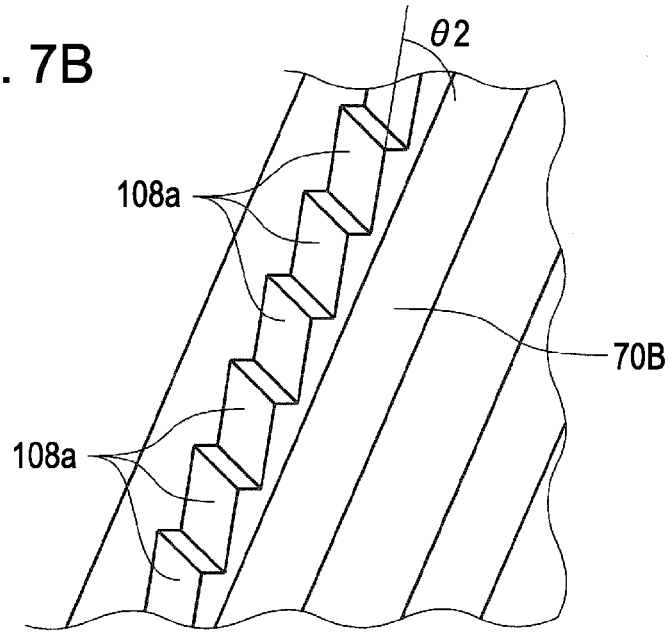
FIG. 7B is an enlarged view of FIG. 7A.
Figure 8:
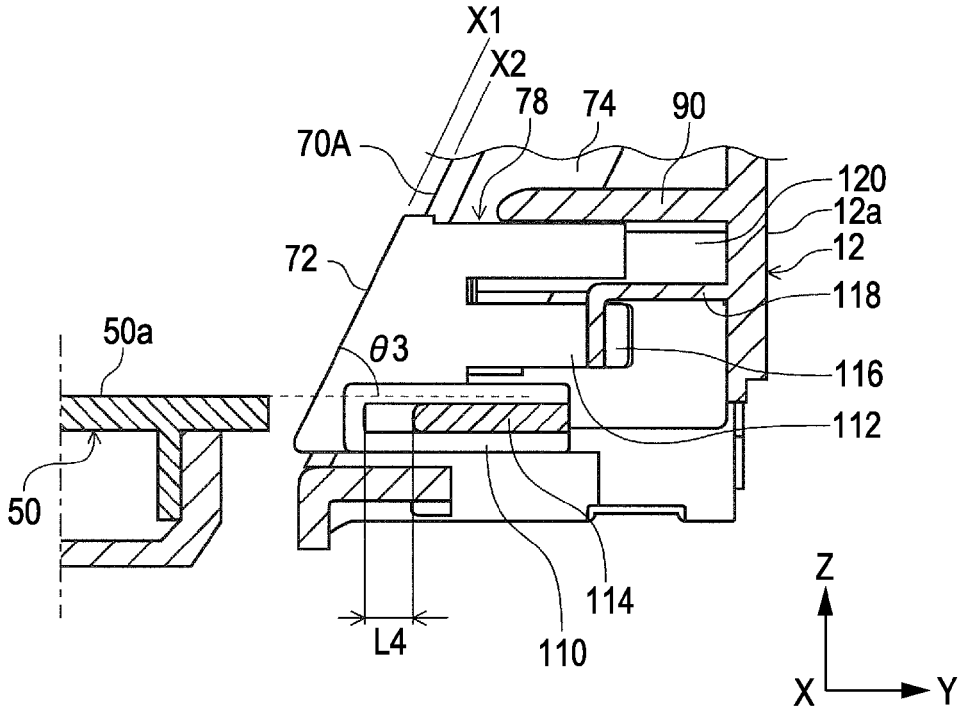
FIG. 8 is a side view of the second movable member of the first embodiment.
Figure 9A:
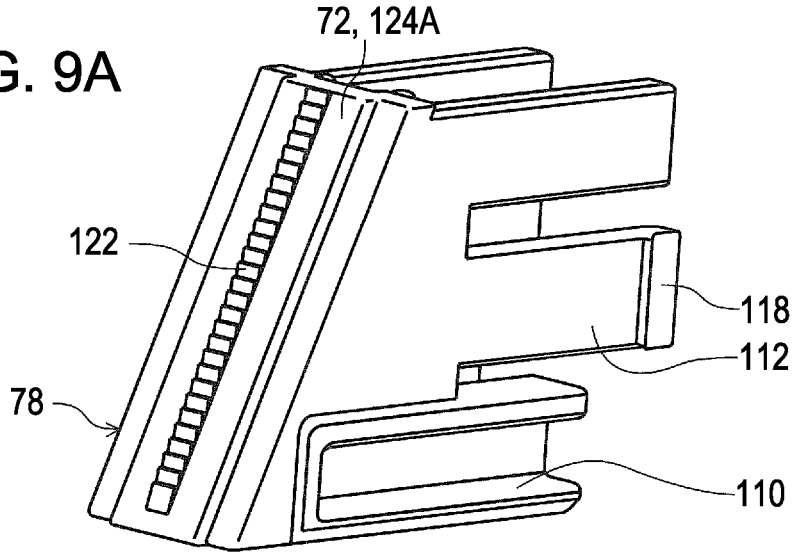
FIG. 9A is a perspective view of the second movable member according to the first embodiment.
Figure 9B:
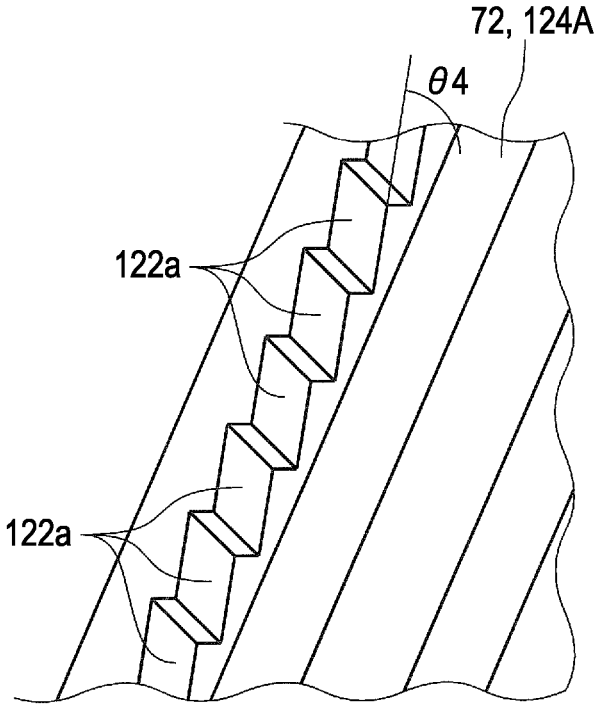
FIG. 9B is an enlarged view of FIG. 9A.
Figure 10:
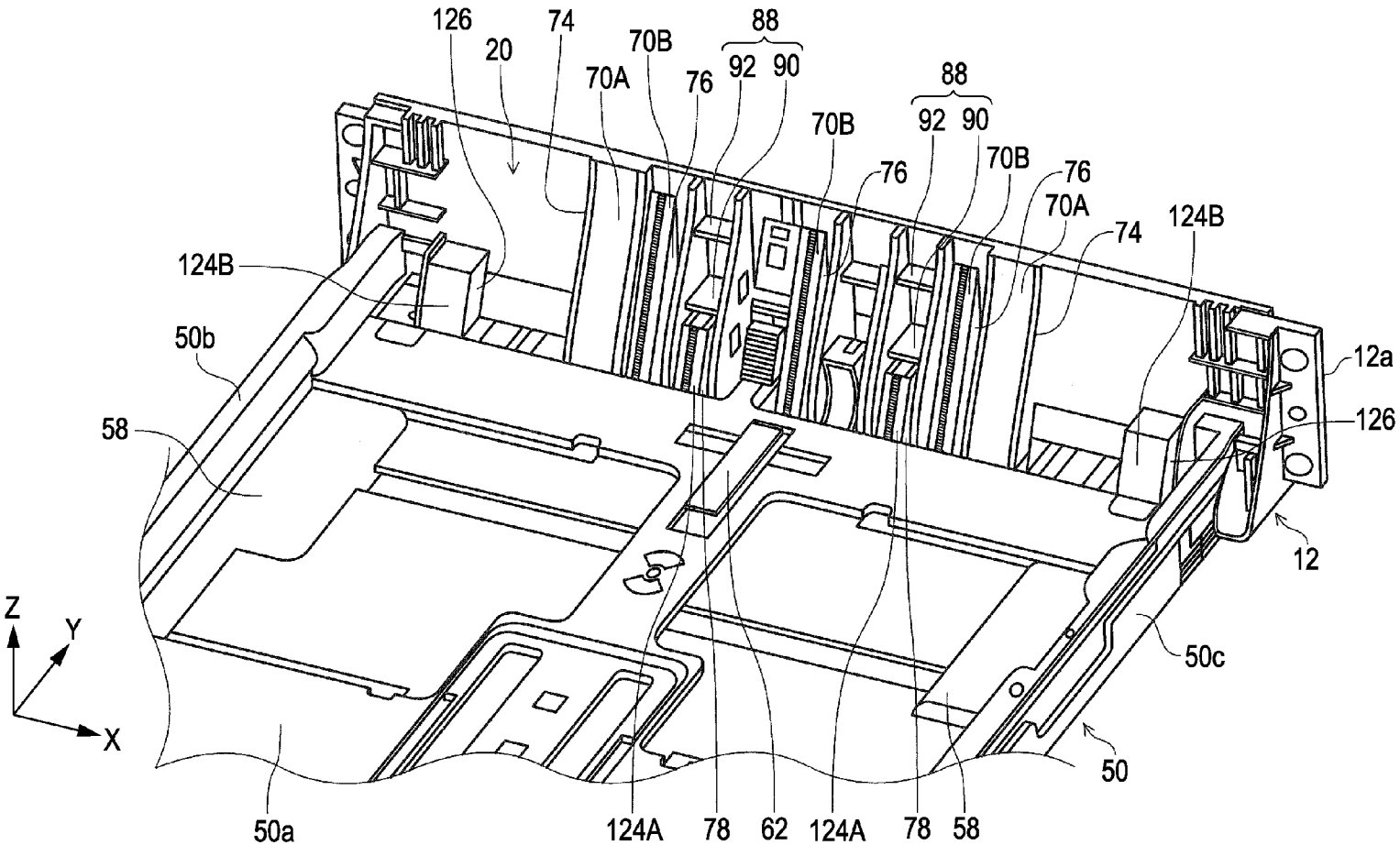
FIG. 10 is a perspective view showing the tip side of paper in a lower stage side tray of a second embodiment.

Moreover, FIG. 5 is a side cross-sectional view of a first movable member of the first embodiment, FIG. 6 is a side view showing a relationship between the first movable member and a first fixing member of the first embodiment, FIG. 7A is a perspective view of the first movable member according to the first embodiment, FIG. 7B is an enlarged view of FIG. 7A, FIG. 8 is a side view of the second movable member of the first embodiment, FIG. 9A is a perspective view of the second movable member according to the first embodiment, FIG. 9B is an enlarged view of FIG. 9A, and FIG. 10 is a perspective view showing the tip side of paper in a lower stage side tray of a second embodiment.

Moreover, in FIG. 1, in order to show rollers which are disposed on the paper transport path of the printer 10, almost all of the rollers are described on the same surface. However, positions of the rollers in the depth direction (front and rear directions of the paper surface in FIG. 1) may not necessarily coincide with one another (may coincide with one another). Moreover, in an X-Y-Z coordinate system shown in each drawing, X direction indicates a direction perpendicular to a paper transport (feed) direction, that is, a paper width direction, Y direction indicates a paper transport direction (feed direction), and Z direction indicates the height direction of the apparatus, that is, the gravity direction.

Hereinafter, an overall configuration of the printer 10 will be described with reference to FIG. 1. The printer 10 includes a recording medium feeding device (hereinafter, referred to as a "feeding device") 12 on the bottom portion of the printer, and includes a configuration which feeds paper (mainly a cut sheet; hereinafter, referred to as "paper P") which is an example of a "recording medium" for each sheet from the recording medium feeding device, performs recording (ink jet recording) in a recording unit 14, and discharges the paper toward a discharge stacker 16 provided on the front side (−Y direction in FIG. 1) of the printer.

Hereinafter, component elements on the paper transport path will described in more detail.

The feeding device 12 includes a lower stage side tray 50, an upper stage side tray 60 which is disposed above the lower stage side tray, pickup rollers 18, and a first separation unit 20. The lower stage side tray 50 and the upper stage side tray 60, which are paper storage portions in which a plurality sheets of paper P can be set in a lamination state, are configured so as to be mounted to and to be removed from the front side of the printer with respect to a device main body 12*a* of the feeding device 12.

Moreover, in FIG. 1, the paper which is stored in the lower stage side tray 50 is represented by a reference numeral P1 and the paper which is stored in the upper stage side tray 60 is represented by a reference numeral P2 (hereinafter, the paper is referred to as "paper P" when the paper is not needed to be particularly distinguished). The lower stage side tray 50 and the upper stage side tray 60 will be described in detail below.

The pickup rollers 18, which are rotated by a motor (not shown), are provided on an oscillation member 24 which oscillates about an oscillation shaft 22, contact the uppermost paper of the paper P1 which is stored in the lower stage side tray 50 in a state where the upper stage side tray 60 slides to the most retraction direction (−Y direction in FIG. 1), that is, in a retracted position, and is rotated. Thereby, the pickup rollers 18 discharge the uppermost paper P1 from the lower stage side tray 50 to the feed path. In addition, the pickup rollers 18 contact the uppermost paper of the paper P2 stored in the upper stage side tray 60 in a position in which the upper stage side tray 60 slides in the innermost direction of the printer (paper discharging direction; +Y direction in FIG. 1) and abuts, that is, in a feedable portion, and is rotated. Thereby, the pickup rollers 18 discharges the uppermost paper P2 from the upper stage side tray 60 to the feed path.

In the device main body 12*a* of the feeding device 12, a first separation unit 20 is provided in a position opposite to the tip of the paper P1 which is set in the lower stage side tray 50, or in a position opposite to the tip of the paper P2 which is set in the upper stage side tray 60. The first separation unit 20 contacts the tip of the paper P which is delivered from the lower stage side tray 50 or the upper stage side tray 60 due to the rotation of the pickup rollers 18, the paper P is transported to the downstream side of the feed path in a state where the paper P contacts the first separation unit 20, and thus, separation between the uppermost paper P and the paper P after the next position is performed. Moreover, the configuration of the first separation unit 20 will be described below.

In the downstream side of the feed path of the first separation unit 20, a second separation unit 30 is provided which is configured so as to include a separation roller 26 and a driving roller 28 which is driven by a motor (not shown) and performs the separation of the paper P. Moreover, in the downstream side of the feed path of the second separation unit 30, a driven roller 32, which sandwiches the paper P between the driving roller 28 and the driven roller 32 and is rotated following it, is provided. In addition, in the downstream side of the feed path of the driven roller 32, a transport unit 38 is provided which includes a transport driving roller 34 which is driven by a motor (not shown) and a transport driven roller 36 which comes into pressure-contact with the transport driving roller and is rotated following it. The paper is further delivered to the downstream side by the transport unit 38.

A recording unit 14 is provided in the downstream side of the transport unit 38. The recording unit 14 includes a recording head 40 and a lower portion guide member 42 opposite to the recording head. The recording head 40 is provided on the bottom portion of a carriage 44 and is opposite to the paper P. The carriage 44 is driven so as to be reciprocated in a main scanning direction (front and rear direction of the paper surface in FIG. 1, that is, X axis direction) due to a driving motor (not shown).

The lower portion guide member 42 supports the paper P and defines a distance between the paper P and the recording head 40.

Moreover, in the downstream side of the lower portion guide member 42, a discharging unit 46 which discharges the paper P on which the recording has been performed is provided. The discharging unit 46 includes a discharge driving roller 48 which is driven by a motor (not shown), and a discharge driven roller 52 which contacts the discharge driving roller and is rotated following it. The paper P on which the recording has been performed by the recording unit 14 is sandwiched by the discharging unit 46 and is discharged to the discharge stacker 16 which is provided in the front side of the printer. Moreover, the discharge stacker 16 is configured so as to be drawn to the front side of the printer.

In addition, when recording is performed on both surfaces of the paper P in the printer 10, after the recording is performed on a first surface of the paper P using the recording unit 14, the side, which becomes the rear end of the paper when recording is performed on the first surface by reverse feed operations of the transport unit 38 and the discharging unit 46, becomes the tip, and the paper P is returned to the upstream side of the transport unit 38. In addition, the paper P is delivered to an inversion path 54 due to a reverse operation of the transport unit 38. The paper P which is delivered into the inversion path 54 is sandwiched by the driving roller 28 and an inversion roller 56, and is returned to the feed path.

The paper P which is returned to the feed path is delivered to the transport unit 38 of the downstream side of the feed path again by the driving roller 28 via the separation roller 26 and the driven roller 32. At this time, the first surface and the second surface of the paper P are curved and inversed, and the second surface is opposite to the recording head 40. The paper P is delivered to the recording unit 14 by the transport unit 38. The paper P on which the recording of the second surface has been performed by the recording unit 14 is sandwiched by the discharging unit 46, and is discharged to the discharge stacker 16 which is provided in the front side of the printer.

As above, the outline of the printer 10 is described, and hereinafter, the lower stage side tray 50 and the upper stage side tray 60 will be described with reference to FIGS. 2 and 3. Both the lower stage side tray 50 and the upper stage side tray 60 configures a paper storage portion, and reference numerals 50*a* and 60*a* indicate the tray bottom surfaces respectively.

A pair of side walls 50*b* and 50*c* is provided in the lower stage side tray 50, and the side walls protrudes from the tray bottom surface 50*a* in the Z axis direction in the X axis direction of the tray bottom surface 50*a*, that is, in both ends in the paper width direction. Moreover, edge guides 58 and 58 which can slide in the X axis direction, that is, the paper width direction are provided in the tray bottom surface 50*a*. The edge guides 58 and 58 regulate the position in the paper width direction of the paper P1. Moreover, an edge guide (reference numeral 59 in FIG. 1) which can slide in the Y axis direction, that is, a paper length direction (paper feeding direction) is provided in the tray bottom surface 50*a*. The edge guide 59 regulates the position of the rear end of the paper P1.

In addition, a high friction material 62 is provided in the tray bottom surface 50*a*, and the high friction material is disposed in a place corresponding to the position in which the pickup rollers 18 and the paper P1 contacts each other. The high friction material 62 holds a bundle of the paper so that each bundle of the paper is delivered to the downstream side of the feed path when the paper is discharged by the pickup rollers 18.

The upper stage side tray 60 is provided so as to slide with respect to the device main body of the printer 10, and the slide direction is the Y axis direction (paper feeding direction). A rack 64 which extends along the Y axis direction is provided on the tray bottom surface 60*a* of the upper stage side tray 60. The rack 64 is engaged with a pinion gear (not shown) which is rotated by a motor (not shown) provided in the printer 10, and advances the upper stage side tray 60 to the feedable position or retreats the upper stage side tray 60 to the retracted position along the Y axis direction.

Moreover, edge guides 66 and 66 which can slide in the X axis direction, that is, the paper width direction are provided on the tray bottom surface 60*a*. The edge guides 66 and 66 regulate the position of the paper P2 in the paper width direction. In addition, edge guides (reference numeral 67 in FIG. 1) which can slide in the Y axis direction, that is, the paper length direction (paper feeding direction) is provided on the tray bottom surface 60*a*. The edge guide 67 regulates the position of the rear end of the paper P2.

Moreover, a high friction material 68 is provided in the tray bottom surface 60*a*, and the high friction material is disposed in a place corresponding to the position in which the pickup rollers 18 and the paper P2 contacts each other. The high friction material 68 holds a bundle of paper so that each bundle of paper is delivered to the downstream side of the feed path when the paper is discharged by the pickup rollers 18.

First Embodiment

As above, the outlines of the lower stage side tray 50 and the upper stage side tray 60 are described, and hereinafter, the first separation unit 20 will be described with reference to FIGS. 2 to 4. The first separation unit 20 includes a first separation inclined surface 70 (70A and 70B) and a second separation inclined surface 72 which provide a separation operation with respect to the tip of the paper.

The first separation inclined surface 70 is an inclined surface which rises from the height position of a bottom surface (50*a*) of at least the lower stage side tray 50, extends up to above the height position of the bottom surface (60*a*) of the upper stage side tray 60, and more specifically, in the embodiment, extends up to further above the position opposite to the uppermost paper P2 when the paper P2 of a maximum sheet which can be stored in the upper stage side tray 60 is stored. That is, the first separation inclined surface 70 is formed on the first fixing member 74 and the first movable member 76 so as to be opposite to the tip of the paper P1 which is set to the lower stage side tray 50 and the tip of the paper P2 which is set to the upper stage side tray 60. Moreover, for the distinction, the first separation inclined surface portion which is formed on the first fixing member 74 is represented by a reference numeral 70A, and the first separation inclined surface portion which is formed on the first movable member 76 is represented by a reference numeral 70B. The first fixing member 74 is provided in the position opposite to the tip of the paper P1 set in the lower stage side tray 50 and the tip of the paper P2 set in the upper stage side tray 60 in the device main body 12*a* of the feeding device 12, and is fixed to the device main body 12*a*. Moreover, at least one first fixing member 74 is provided along the X direction in the device main body 12*a*, that is, along the paper width direction.

The first movable member 76 is provided in the position opposite to the tip of the paper P1 set in the lower stage side tray 50 and the tip of the paper P2 set in the upper stage side tray 60 in the device main body 12*a* of the feeding device 12, and can be displaced in a direction which advances to and retreats from the tips of the paper P1 and P2. Moreover, at least one first movable member 76 is provided along the X direction in the device main body 12*a*, that is, along the paper width direction. In addition, the first separation inclined surface portions 70A and 70B extend along above the inclination, that is, along the paper feeding direction so as to form an opening angle with respect to a paper superimposed direction from the tray bottom surfaces 50*a* and 60*a*.

The second separation inclined surface 72 is an inclined surface which rises from the height position of a bottom surface (50*a*) of at least the lower stage side tray 50, and is formed on a second movable member 78 so as to be opposite to only the tip of the paper P1 which is set in the lower stage side tray 50. The second movable member 78 is provided in the position opposite to the tip of the paper P1 set in the lower stage side tray 50 in the device main body 12*a* of the feeding device 12, and can be displaced in a direction which advances to and retreats from the tip of the paper P1. Moreover, at least one second movable member 78 is provided along the X direction in the device main body 12*a*, that is, along the paper width direction. The second separation inclined surface 72 extends along above the inclination, that is, along the paper feeding direction so as to form an opening angle with respect to a paper superimposed direction from the tray bottom surface 50*a*.

In the first separation inclined surface portions 70A and 70B, a starting end 80 is positioned below the tray bottom surface 50*a* of the lower stage side tray 50 and extends along the paper feed path, a trailing end 82 is positioned above the tray bottom surface 60*a* of the upper stage side tray 60 and is positioned above uppermost paper P2 when the paper P2 of a maximum sheet which can be stored in the upper stage side tray 60 is stored, and the first separation inclined surface portions includes a separation inclined surface length L1 (refer to FIG. 4). In addition, in the second separation inclined surface 72, a starting end 84 is positioned below the tray bottom surface 50*a* of the lower stage side tray 50 and extends along the paper feed path, a trailing end 86 is positioned below the tray bottom surface 60*a* of the upper stage side tray 60, and the second separation inclined surface includes a separation inclined surface length L2 (refer to FIG. 4) shorter than the separation inclined surface length L1. That is, the second separation inclined surface 72 is not opposite to the tip of the paper P2 which is set in the upper stage side tray and does not contact the tip of the paper P2 when the paper P2 is fed.

In addition, the second movable member 78 is configured so that the height in the Z axis direction, that is, the height direction of the printer is lower than that of the first movable member 76. A regulating portion 88 is provided above the second movable member 78 in the device main body 12*a*. The regulating portion 88 includes a lower regulating portion 90 and an upper regulating portion 92 which is provided above the lower regulating portion. When the upper stage side tray 60 is positioned in the feedable position, the lower regulating portion 90 supports a tip portion 60*d* of the tray bottom surface 60*a* of the upper stage side tray 60 from the lower portion and prevents the upper stage side tray 60 from being deformed due to its own weight or the weight of the paper P2. Moreover, the regulating portion 88 receives the tip portion 60*d* of the upper stage side tray 60 between the lower regulating portion 90 and the upper regulating portion 92, and regulates the position in the Z axis direction of the upper stage side tray 60.

The configuration of the first movable member 76 will be described with reference to FIG. 5. When viewed in the X axis direction, that is, in the paper width direction, the first movable member 76 is configured by a block material in which the first separation inclined surface portion 70B becomes an oblique side and which has an approximately right-angled triangular shape. The first separation inclined surface 70B forms an inclination angle θ1 with respect to the tray bottom surface 50*a* of the lower stage side tray 50. In addition, the first separation inclined surface 70A is also set so as to form an inclination angle θ1 with respect to the tray bottom surface 50*a* of the lower stage side tray 50. Moreover, a guide portion 94 and a hook shaped portion 96 are provided in the first movable member 76. The guide portion 94 is formed by a slit which extends along the Y axis direction. The guide portion 94 is fitted to a protrusion piece 98 which is provided in the device main body 12*a* and protrudes toward the tip side of the paper P along the Y axis direction from the device main body, and guides the first movable member 76 so as to be slidable in the Y axis direction.

The hook shaped portion 96 protrudes from the first movable member 76, extends to the device main body 12*a* side (+Y direction in FIG. 5), and includes a hook 102, which protrudes in the X axis direction, in the tip. When the first movable member 76 moves to the tip side of the paper P in a predetermined amount, the hook 102 is locked to a stopper piece 104 which is provided in the device main body 12*a* and protrudes toward the tip of the paper P along the Y axis direction from the device main body 12*a*, and regulates the movement of the first movable member 76 toward the tip side (−Y direction in FIG. 5) of the paper P. Thereby, the first movable member 76 is configured so as to advance and retreat with respect to the device main body 12*a* within a range of a distance L3 capable of sliding along the Y axis direction.

In addition, a spring member 106 which is a biasing unit is provided between the first movable member 76 and the device main body 12*a*. The spring member 106 is provided so as to be expandable in the Y axis direction and is configured so as to apply a predetermined biasing force, which biases the first movable member toward the tip side of the paper P, to the first movable member 76. In addition, the biasing force of the spring member 106 is set to a value in which a state where the first movable member 76 protrudes toward the tip side of the paper P is maintained when paper having low stiffness such as a regular paper is fed, and the first movable member 76 is pushed by the tip of the paper having high stiffness and is deformed when paper having high stiffness such as exclusive paper is fed.

With reference to FIG. 6, when the first movable member 76 does not contact the paper P, the first movable member is biased by the spring member 106 and protrudes to the tip side (−Y direction in FIG. 6) of the paper P. At this time, the first separation inclined surface portion 70B formed on the first movable member 76 reaches a protrusion state X1 which further protrudes to the tip side (−Y direction in FIG. 6) of the paper P than the first separation inclined surface portion 70A which is formed on the first fixing member 74. In the first separation inclined surface portion 70B which is formed on the first movable member 76, when the tip of the paper having low stiffness such as a regular paper contacts the first separation inclined surface portion 70B, the protrusion state X1 is maintained by the biasing force of the spring member 106. Moreover, in the first separation inclined surface portion 70B which is formed on the first movable member 76, when the tip of the paper having high stiffness such as a special paper contacts the first separation inclined surface portion 70B, the first separation inclined surface portion 70B is pushed by the tip of the paper having high stiffness, is displaced, is retreated up to the same position as the first separation inclined surface portion 70A formed on the first fixing member 74, and reaches a displacement state X2.

With reference to FIGS. 7A and 7B, the first separation inclined surface portion 70B formed on the first movable member 76 further includes a stepped portion 108 which extends along the feed path direction. A plurality of contact surfaces 108*a* which contacts the tip of the paper P are provided on the stepped portion 108. The contact surfaces 108*a* are configured so as to form an angle θ2 with respect to the first separation inclined surface portion 70B. That is, the contact surfaces 108*a* form an inclination angle θ1+θ2 with respect to the tray bottom surfaces 50*a* and 60*a* and can increase the friction force which is generated in the tip of the paper P compared to the time of the inclination angle θ1. The stepped portion 108 improves separability of the paper P in the first separation inclined surface portion 70B which is formed on the first movable member 76.

With reference to FIG. 8, the configuration of the second movable member 78 will be described. When viewed in the X axis direction, that is, in the paper width direction, the second movable member 78 is configured by a block material in which the second separation inclined surface 72 becomes an oblique side. The second separation inclined surface 72 forms an inclination angle θ3 with respect to the tray bottom surface 50*a* of the lower stage side tray 50. The inclination angle θ3 in the embodiment is set so as to have the same angle as the inclination angle θ1 which is formed between the first separation inclined surface portions 70A and 70B and the tray bottom surface 50*a*.

Moreover, a guide portion 110 and a hook shaped portion 112 are provided in the second movable member 78. The guide portion 110 is formed by a slit which extends along the Y axis direction. The guide portion 110 is fitted to a protrusion piece 114 which is provided in the device main body 12*a* and protrudes toward the tip side of the paper P along the Y axis direction from the device main body, and guides the second movable member 78 so as to be slidable in the Y axis direction.

The hook shaped portion 112 protrudes from the second movable member 78, extends to the device main body 12*a* side, and includes a hook 116, which protrudes in the X axis direction, in the tip. When the second movable member 78 moves to the tip side of the paper P in a predetermined amount, the hook 116 is locked to a stopper piece 118 which is provided in the device main body 12*a* and protrudes toward the tip of the paper P along the Y axis direction from the device main body 12*a*, and regulates the movement of the second movable member 78 toward the tip side (−Y direction in FIG. 8) of the paper P. Thereby, the second movable member 78 is configured so as to advance and retreat with respect to the device main body 12*a* within a range of a distance L4 capable of sliding along the Y axis direction. In the embodiment, the slidable distance L4 of the second movable member 78 is set so as to have the same distance as the slidable distance L3 of the first movable member 76.

In addition, a spring member 120 which is a biasing unit is provided between the second movable member 78 and the device main body 12*a*. The spring member 120 is provided so as to be expandable in the Y axis direction and is configured so as to apply a predetermined biasing force, which biases the second movable member toward the tip side of the paper P, to the second movable member 78. Moreover, the biasing force of the spring member 120 in the embodiment is set so as to have the same force as the biasing force of the spring member 106 which biases the first movable member 76.

In addition, the second separation inclined surface 72 which is formed on the second movable member 78 is biased by the spring member 120, and similar to the first separation inclined surface portion 70B which is formed on the first movable member 76, reaches the protrusion state X1 which further protrudes to the tip side (−Y direction in FIG. 8) of the paper P than the first separation inclined surface portion 70A which is formed on the first fixing member 74. In the second separation inclined surface 72 which is formed on the second movable member 78, when the tip of the paper having low stiffness such as a regular paper contacts the second separation inclined surface 72, the protrusion state X1 is maintained by the biasing force of the spring member 120. In the second separation inclined surface 72, when the tip of the paper having high stiffness such as a special paper contacts the second separation inclined surface 72, the second separation inclined surface 72 is pushed by the tip of the paper having high stiffness, is displaced, is retreated up to the same position as the first separation inclined surface portion 70A formed on the first fixing member 74, and reaches the displacement state X2.

With reference to FIGS. 9A and 9B, the second separation inclined surface 72 formed on the second movable member 78 further includes a stepped portion 122 which extends along the feed path direction. A plurality of contact surfaces 122*a* which contact the tip of the paper P are provided on the stepped portion 122. The contact surfaces 122*a* are configured so as to form an angle θ4 with respect to the second separation inclined surface 72. That is, the contact surfaces 122*a* form an inclination angle θ3+θ4 with respect to the tray bottom surfaces 50*a* and can increase the friction force which is generated in the tip of the paper P compared to the time of the inclination angle θ3. The stepped portion 122 improves separability of the paper P in the second separation inclined surface 72 which is formed on the second movable member 78. In addition, in the embodiment, the angle θ4 between the contact surface 122*a* and the second separation inclined surface 72 is set so as to have the same angle as the angle θ2 between the contact surface 108*a* and the first separation inclined surfaces 70A and 70B.

With reference to FIGS. 2 and 3 again, the feeding of the recording medium in the embodiment will be described.

(1) When a recording medium having low stiffness (hereinafter, referred to as a "first recording medium") such as a regular paper is fed from the lower stage side tray 50, the tip of the first recording medium contacts the first separation inclined surface portion 70B which is formed on the first movable member 76 and the second separation inclined surface 72 which is formed on the second movable member 78. The first recording medium is separated in the first separation inclined surface portion 70B which is formed on the first movable member 76 and the second separation inclined surface 72 which is formed on the second movable member 78, and is delivered to the downstream side of the feed path.

(2) When the first recording medium is fed from the upper stage side tray 60, the tip of the first recording medium contacts only the first separation inclined surface portion 70B which is formed on the first movable member 76. The first recording medium is separated in the first separation inclined surface portion 70B which is formed on the first movable member 76, and is delivered to the downstream side of the feed path.

(3) When a recording medium having high stiffness (hereinafter, referred to as a "second recording medium") such as a special paper is fed from the lower stage side tray 50, the tip of the second recording medium contacts the first separation inclined surface portion 70B which is formed on the first movable member 76 and the second separation inclined surface 72 which is formed on the second movable member 78. In addition, the tip of the second recording medium pushes and displaces the first separation inclined surface portion 70B which is formed on the first movable member 76 and the second separation inclined surface 72 which is formed on the second movable member 78, and contacts the first separation inclined surface portion 70A which is formed on the first fixing member 74. The second recording medium is separated in the first separation inclined surface portion 70A which is formed on the first fixing member 74, and is delivered to the downstream side of the feed path.

(4) When the second recording medium is fed from the upper stage side tray 60, the tip of the second recording medium contacts the first separation inclined surface portion 70B which is formed on the first movable member 76, pushes and displaces the first separation inclined surface portion 70B which is formed on the first movable member 76, and contacts the first separation inclined surface portion 70A which is formed on the first fixing member 74. The second recording medium is separated in the first separation inclined surface portion 70A which is formed on the first fixing member 74, and is delivered to the downstream side of the feed path.

As described above, according to the embodiment, the tip of the paper P1 which is stored in the lower stage side tray 50 initially contacts the first separation inclined surface portion 70B and the second separation inclined surface 72 when the paper P1 is fed, and the tip of the paper P2 which is stored in the upper stage side tray 60 initially contacts the first separation inclined surface portion 70B when the paper P2 is fed. That is, in the embodiment, in the paper P1 which is stored in the lower stage side tray 50 and the paper P2 which is stored in the upper stage side tray 60, the number of the separation inclined surfaces on which the tip of the paper P1 or the tip of the paper P2 initially contacts can be changed.

In the embodiment, when the paper P2 stored in the upper stage side tray 60 is fed, since the number of the separation inclined surfaces which contact the tip of the paper P2 is decreased, the resistance where the tip of the paper P2 receives from the separation inclined surface is decreased, and when the paper P2 discharged from the upper stage side tray 60 is an exclusive paper, the tip of the paper can easily contact the first separation inclined surface portion 70A compared to a case where the tip of the paper is discharged from the lower stage side tray 50.

Therefore, in the embodiment, separation conditions with respect to the paper P2 which is stored in the upper stage side tray 60 can be the separation conditions suitable for the upper stage side tray 60 which is configured with assumptions in that paper having a small size such as photographic paper or a postcard and having high stiffness is stored in most cases. That is, the feeding device 12 in the embodiment can set appropriate separation conditions with respect to the lower stage side tray 50 and the upper stage side tray 60.

Second Embodiment

FIG. 10 shows a second embodiment. As shown in FIG. 10, the second embodiment is different from the above-described first embodiment in that the second embodiment includes a second fixing member 126 on which a second separation inclined surface 124B is formed. In addition, for the distinction in the embodiment, a second separation inclined surface portion which is formed on the second movable member 78 is represented by a reference numeral 124A, and a second separation inclined surface portion which is formed on the second fixing member 126 is represented by a reference numeral 124B. Other configurations are similar to the above-described first embodiment.

The second fixing member 126 is provided in the position opposite to the tip of the paper P1 which is set in the lower stage side tray 50 in the device main body 12*a* of the feeding device 12, and is fixed to the device main body 12*a*. Moreover, at least one second fixing member 126 is provided along the X direction in the device main body 12*a*, that is, the paper width direction. In addition, the second separation inclined surface portion 124B is formed so as to be opposite to the tip of the paper P1 in the second fixing member 126. According to the above-described configuration, the friction force which is generated between the tip of the second recording medium and the second separation inclined surface portions 124A and 124B is larger than the friction force which is generated between the tip of the second recording medium and the first separation inclined surface portions 70A and 70B. Thereby, it is possible to further improve the separability of the second recording medium in the second separation inclined surface portions 124A and 124B than the separability of the second recording medium in the first separation inclined surface portions 70A and 70B.

In the second embodiment, when the second recording medium is fed from the lower stage side tray 50, the tip of the second recording medium contacts the first separation inclined surface portion 70B which is formed on the first movable member 76 and the second separation inclined surface portion 124A which is formed on the second movable member 78. In addition, the tip of the second recording medium pushes and displaces the first separation inclined surface portion 70B which is formed on the first movable member 76 and the second separation inclined surface portion 124A which is formed on the second movable member 78, and contacts the second separation inclined surface portion 124B which is formed on the second fixing member 126. The second recording medium is separated in the second separation inclined surface 124B which is formed on the second fixing member 126, and is delivered to the downstream side of the feed path.

Modification Examples of First and Second Embodiments

In addition, the above-described first and second embodiments may be modified as follows.

(1) The inclination angle θ1 of the first separation inclined surface portions 70A and 70B may be different from the inclination angle θ3 of the second separation inclined surfaces (second separation inclined surface portions) 72, 124A, and 124B. Particularly, the inclination angle θ3 of the second separation inclined surfaces (second separation inclined surface portions) 72, 124A, and 124B is larger than the inclination angle θ1 of the first separation inclined surface portions 70A and 70B, and thus, the friction force which is generated between the tip of the paper P and the second separation inclined surfaces (second separation inclined surface portions) 72, 124A, and 124B is larger than the friction force which is generated between the tip of the paper P and the first separation inclined surface portions 70A and 70B. Thereby, it is possible to further improve the separability of the recording medium in the second separation inclined surfaces (second separation inclined portions) 72, 124A, and 124B than the separability of the recording medium in the first separation inclined surface portions 70A and 70B.

(2) Only the first fixing member 74 and the second fixing member 126 may be configured so as to be provided instead of the configuration in which the first movable member 76 and the second movable member 78 are provided in the device main body 12*a*.

(3) The angle θ2 between the first separation inclined surface portion 70B which is formed on the first movable member 76 and the contact surface 108*a* of the stepped portion 108 which is provided on the first separation inclined surface portion 70B may be different from the angle θ4 between the second separation inclined surfaces (second separation inclined surface portions) 72 and 124A which are formed on the second movable member 78 and the contact surface 122*a* of the stepped portion 122 which is provided on the second separation inclined surfaces (second separation inclined surface portions). Particularly, the angle θ4 is larger than the angle θ2, and thus, when the first recording medium is fed from the lower stage side tray 50, the separability of the first recording medium in the second separation inclined surfaces (second separation inclined surface portions) 72 and 124A can be improved.

(4) The first movable member 76 and the second movable member 78 may be a configuration in which the respectively formed stepped portions 108 and 122 are not provided.

(5) The first separation inclined surface portions 70A and 70B and the second separation inclined surfaces (second separation inclined surface portions) 72, 124A, and 124B may be configured by a surface having high friction. Particularly, the friction coefficients of the second separation inclined surfaces (second separation inclined surface portions) 72, 124A, and 124B are set so as to be larger than the friction coefficients of the first separation inclined surface portions 70A and 70B, and thus, the separability of the first recording medium in the second separation inclined surfaces (second separation inclined surface portions) 72, 124A, and 124B can be improved.

(6) The unit which biases the first movable member 76 and the second movable member 78 may use air pressure, oil pressure, or the like instead of the spring members 106 and 120.

(7) In each embodiment, each of the lower stage side tray 50 and the upper stage side tray 60 is detachably configured so as to be separate and independent with respect to the device main body. However, after the lower stage side tray 50 and the upper stage side tray 60 are integrally configured and the upper stage side tray 60 is slidably provided with respect to the lower stage side tray 50, two top and bottom trays may be detachably configured integrally with respect to the device main body. At this time, the first fixing member 74 and the first movable member 76 on which the first separation inclined surface portions 70A and 70B are formed, and the second fixing member 126 and the second movable member 78 on which the second separation inclined surfaces (second separation inclined surface portions) 72, 124A, and 124B are formed may be provided on the lower stage side tray 50 not the device main body side.

In addition, in the embodiments, the feeding device 12 according to the invention is applied to the ink jet printer which is an example of the recording apparatus. However, in general, the feeding device can be applied to other liquid ejecting apparatuses.

Here, the liquid ejecting apparatus is not limited to the recording apparatuses such as a printer, a copier, and a facsimile machine in which an ink jet type recording head is used, ink is ejected from the recording head, and recording is performed on the recording medium. That is, the liquid ejecting apparatus also includes an apparatus in which liquid corresponding to the use instead of the ink is ejected to a medium, to which the liquid is ejected, corresponding to the recording medium from a liquid ejecting head corresponding to the ink jet type recording head, and the liquid is attached to the medium to which the liquid is ejected.

As for the liquid ejecting head, in addition to the recording head, there is a color material ejecting head which is used for manufacturing a color filter such as a liquid crystal display, an electrode material (conductive paste) ejecting head which is used for forming electrodes of an organic EL display, a field emission display (FED), or the like, a bioorganic material ejecting head which is used for manufacturing a bio chip, a sample ejecting head which is a precise pipette, and the like.

Moreover, the invention is not limited to the embodiments, various modifications can be performed within the scope of the invention described in claims, and it is needless to say that the modifications are included in the scope of the invention.

The entire disclosure of Japanese Patent Application No. 2012-039680, filed Feb. 27, 2012, is expressly incorporated by reference herein.

What is claimed is:

1. A recording medium feeding device, comprising:

a lower stage side tray which stores a recording medium;

an upper stage side tray which is provided above the lower stage side tray and stores the recording medium;

a first separation inclined surface which is an inclined surface which rises from a position of a bottom surface of at least the lower stage side tray, extends up to above a position of a bottom surface of the upper stage side tray, and thus, is opposite to a tip of the recording medium which is stored in the lower stage side tray and the upper stage side tray, and applies a separation operation with respect to the tip of the recording medium; and a second separation inclined surface which is an inclined surface which rises from the position of the bottom surface of at least the lower stage side tray, in which a trailing end of the second separation inclined surface is positioned below the bottom surface of the upper stage side tray, and thus, which is opposite to the tip of the recording medium which is stored in the lower stage side tray without being opposite to the tip of the recording medium which is stored in the upper stage side tray and applies a separation operation with respect to the tip of the recording medium.

2. The recording medium feeding device according to claim 1, wherein a regulating portion which regulates deformation of the upper stage side tray is provided above the second separation inclined surface.

3. The recording medium feeding device according to claim 1, wherein the first separation inclined surface and the second separation inclined surface are formed so that a friction force between the tip of the recording medium and the second separation inclined surface is larger than a friction force between the tip of the recording medium and the first separation inclined surface.

4. The recording medium feeding device according to claim 3, wherein an inclination angle of the second separation inclined surface is larger than an inclination angle of the first separation inclined surface.

5. The recording medium feeding device according to claim 1, wherein the first separation inclined surface is formed on a first movable member which can displace in directions which advance to and retreat from the tip of the recording medium and is biased toward the tip of the recording medium, and on a first fixing member which does not displace in the advancing and retreating directions, when the recording medium is not discharged, the first separation inclined surface portion which is formed on the first movable member becomes a protrusion state in which the first separation inclined surface portion further protrudes to the tip side of the recording medium than the first separation inclined surface portion which is formed on the first fixing member, when a first recording medium having a predetermined stiffness is discharged, the first separation inclined surface portion which is formed on the first movable member maintains the protrusion state, and when a second recording medium having higher stiffness than the stiffness of the first recording medium is discharged, the first movable member is pushed and displaced by the tip of the second recording medium, and thus, the tip of the second recording medium contacts the first separation inclined surface portion which is formed on the first fixing member.

6. The recording medium feeding device according to claim 5, wherein the second separation inclined surface is formed on a second movable member which can displace in directions which advance to and retreat from the tip of the recording medium and is biased toward the tip of the recording medium, when the recording medium is not discharged, the first separation inclined surface portion which is formed on the first movable member and the second separation inclined surface portion which is formed on the second movable member become a protrusion state in which the first separation inclined surface portion and the second separation inclined surface portion further protrude to the tip side of the recording medium than the first separation inclined surface portion which is formed on the first fixing member, when the first recording medium is discharged, the first separation inclined surface portion which is formed on the first movable member and the second separation inclined surface portion which is formed on the second movable member maintain the protrusion state, and when the second recording medium is discharged, the first movable member and the second movable member are pushed and displaced by the tip of the second recording medium, and thus, the tip of the second recording medium contacts the first separation inclined surface portion which is formed on the first fixing member.

7. The recording medium feeding device according to claim 6, wherein the second separation inclined surface is also formed on a second movable member which is not displaced in directions which advance to and retreat from the tip of the recording medium, in addition to the second movable member, when the recording medium is not discharged, the first separation inclined surface portion which is formed on the first movable member and the second separation inclined surface portion which is formed on the second movable member become a protrusion state in which the first separation inclined surface portion and the second separation inclined surface portion further protrude to the tip side of the recording medium than the first separation inclined surface portion which is formed on the first fixing member and the second separation inclined surface portion which is formed on the second fixing member, when the first recording medium is discharged, the first separation inclined surface portion which is formed on the first movable member and the second separation inclined surface portion which is formed on the second movable member maintain the protrusion state, and when the second recording medium is discharged, the first movable member and the second movable member are pushed and displaced by the tip of the second recording medium, and thus, the tip of the second recording medium contacts the first separation inclined surface portion which is formed on the first fixing member and the second separation inclined surface portion which is formed on the second fixing member.

8. The recording medium feeding device according to claim 5, wherein the first separation inclined surface which is formed on the first movable member is formed in a step shape along the feed path.

9. A recording apparatus comprising:

a recording unit which performs recording on a recording medium; and the recording medium feeding unit according to claim 1.

* * * * *